US011384540B2

(12) United States Patent
Hubbard et al.

(10) Patent No.: US 11,384,540 B2
(45) Date of Patent: Jul. 12, 2022

(54) TIMBER BEAM END CONNECTION USING EMBEDDED MECHANICAL FASTENING

(71) Applicant: Lakehead University, Thunder Bay (CA)

(72) Inventors: Cory William Hubbard, Kakabeka Falls (CA); Osama Salem, Thunder Bay (CA)

( * ) Notice: Subject to any disclaimer, the term of this patent is extended or adjusted under 35 U.S.C. 154(b) by 1 day.

(21) Appl. No.: 16/881,242

(22) Filed: May 22, 2020

(65) Prior Publication Data

US 2020/0385989 A1 Dec. 10, 2020

(30) Foreign Application Priority Data

Jun. 4, 2019 (CA) ..... CA 3045195

(51) Int. Cl.
*E04C 3/12* (2006.01)
*E04C 3/36* (2006.01)
*E04B 1/24* (2006.01)

(52) U.S. Cl.
CPC ..... *E04C 3/12* (2013.01); *E04B 1/2403* (2013.01); *E04C 3/36* (2013.01); *E04B 2001/2457* (2013.01); *E04B 2001/2463* (2013.01)

(58) Field of Classification Search
CPC ... E04C 3/12; E04C 3/36; E04C 3/122; E04B 1/2403; E04B 2001/2457; E04B 2001/2463; E04B 2001/2652; E04B 1/2604
See application file for complete search history.

(56) References Cited

U.S. PATENT DOCUMENTS 1,936,439 A * 11/1933 Siever ..... B27G 1/00 427/291
3,820,293 A * 6/1974 Ohe ..... E04B 1/2604 52/127.12
4,925,331 A * 5/1990 Bertsche ..... E04B 1/2604 403/266
5,061,111 A * 10/1991 Hosokawa ..... E04C 3/36 403/232.1
5,253,945 A * 10/1993 Hosokawa ..... E04B 1/2604 403/258
5,480,251 A * 1/1996 Pavageau ..... E04B 1/2604 403/256

(Continued)

FOREIGN PATENT DOCUMENTS

JP 2014031708 A * 2/2014

*Primary Examiner* — Rodney Mintz
(74) *Attorney, Agent, or Firm* — Ryan W. Dupuis; Kyle R. Satterthwaite; Ade & Company Inc.

(57) ABSTRACT

A beam connecting system uses a threaded connector rod and a mating connector, for example a nut, for mounting the end of a wood beam against the upright supporting surface of a supporting body. The connector rod protrudes from the upright supporting surface of the supporting body to be received in a fastener bore extending longitudinally into the beam from the end face of the beam. A transverse access bore which intersects the fastener bore receives the mating connector to form a mechanical connection to fasten the end face of the beam against the upright supporting surface. A wood plug encloses the access bore such that the mechanical connection is fully embedded in the beam and supporting body so as to be surrounded by wood material, and thus be protected from elevated temperatures in fire condition.

10 Claims, 8 Drawing Sheets

(56) References Cited

U.S. PATENT DOCUMENTS

| | | | | |
|---|---|---|---|---|
| 5,741,083 | A * | 4/1998 | Schvartz | E04B 1/2604 403/297 |
| 5,823,701 | A * | 10/1998 | Goto | E04B 1/2604 403/268 |
| 6,827,520 | B2 * | 12/2004 | Reichartz | E04C 3/29 403/192 |
| 8,186,124 | B2 * | 5/2012 | Bathon | F16B 13/141 52/701 |
| 8,857,119 | B2 * | 10/2014 | Nakashima | E04C 3/18 52/223.8 |
| 8,950,126 | B2 * | 2/2015 | Imai | E04H 9/02 52/167.4 |
| 9,249,817 | B2 * | 2/2016 | Imai | E04B 1/4157 |
| 10,422,123 | B2 * | 9/2019 | Holland | E04B 1/2612 |
| 10,876,284 | B2 * | 12/2020 | Knapp | E04B 1/40 |
| 2003/0056461 | A1 * | 3/2003 | Torrey | E04B 5/12 52/837 |
| 2003/0167723 | A1 * | 9/2003 | Reichartz | E04C 3/293 52/655.1 |
| 2008/0213040 | A1 * | 9/2008 | Morze-Reichartz | E04C 3/18 403/381 |
| 2014/0090315 | A1 * | 4/2014 | Imai | E04B 1/49 52/167.1 |
| 2014/0090317 | A1 * | 4/2014 | Nakashima | E04C 3/18 52/223.8 |
| 2014/0093306 | A1 * | 4/2014 | Imai | E04B 1/4157 403/180 |
| 2016/0289949 | A1 * | 10/2016 | Okura | E04B 1/2604 |
| 2018/0127971 | A1 * | 5/2018 | Holland | E04B 1/2612 |
| 2019/0390455 | A1 * | 12/2019 | Knapp | F16B 5/121 |
| 2021/0252737 | A1 * | 8/2021 | Hummel | E04B 5/12 |

* cited by examiner

TIMBER BEAM END CONNECTION USING EMBEDDED MECHANICAL FASTENING

This application claims foreign priority benefits from Canadian Patent Application 3,045,195, filed Jun. 4, 2019.

FIELD OF THE INVENTION

The present invention relates to a connecting system using a connector rod and a mating connector arranged to form a mechanical connection to the connector rod, for example a threaded rod and mating nut, for fastening the end of a beam against the upright supporting surface of a supporting body such as a column in which the connector rod and mating connector are fully embedded within the beam to improve the fire resistance of the end connection of the beam.

BACKGROUND

Bolt and plate connections offer a simple yet strong connection in timber buildings; however, their fire performance, when unprotected, is minimal.

Glued-laminated timber (glulam) is one of the most commonly-used engineered-wood products, which has its potential still being researched to utilize its abilities fully. The areas most lacking in the available design guidelines of glulam are embedded-rod connections (Hunger et al., 2016) and moment-resisting connections (Petrycki and Salem, 2017). Glued-in threaded steel rods have been in use and experimentally tested since the late 1980's; however, there are no consistent design procedures for their application (Barillas, 2014; Fragiacomo and Batchelar, 2012). Some design approaches and code models have been published; however, there are some discrepancies and even partial contradictions between the different available models (Steiger et al., 2006). The interaction between wood, adhesive and metal, introduces several variables which need to be carefully considered, making it difficult to predict the connection's failure mode (Oh, 2016). A primary issue with connections composed of glued rods in timber sections is when the connection must be made on site. This type of application has been shown to carry a high risk of having the rods being improperly bonded since the effectiveness of the grouting process cannot be visually checked (Batchelar and McIntosh, 1998). Therefore, it is highly recommended that the gluing process is done in a controlled environment, where skilled workers can check their work and ensure a proper bond between the steel rods and the wood sections.

Timber connections utilizing embedded rods have the advantage of being superior in fire performance compared to other connection types since the steel rods are completely concealed inside the wood section. Even a connection where only a slight portion of the steel rod is exposed still has considerably high charring rate due to the fact that steel components quickly conduct heat into the connection (Barber, 2017). Also, issues with the epoxy at elevated temperatures still need to be further investigated. A study done by (Di Maria et al., 2017) shows that epoxy deteriorates, and thus the connection can easily fail when temperature reaches thresholds of only 50° C. to 60° C.

The following prior art references are referred to throughout the current specification.

[1] Barber, D. (2017). *Determination of fire resistance ratings for glulam connectors within US high rise timber buildings*. Fire Safety Journal, 14 Apr. 2017, pp 579-585.

[2] Barillas, E. G. (2014). *Capacity of Connections in Glulam with Single and Multiple Glued in Steel Rods*. Master's thesis. UBC, Vancouver, Canada, 20 Dec. 2014.

[3] Batchelar, M. L., and McIntosh, K. A. (1998). *Structural Joints in Glulam*. 5th World Conference on Timber Engineering, Montreux, Switzerland, 17-20 Aug. 1998, pp 289-296.

[4] Di Maria, V., D'Andria, L., Muciaccia, G., and Ianakiev, A. (2017). *Influence of elevated temperature on glued-in steel rods for timber elements*. Construction and Building Materials, 2 May 2017, pp 457-465.

[5] Fragiacomo, M., and Batchelar, M. (2012). *Timber Frame Moment Joints with Glued-In Steel Rods. I: Design*. Journal of Structural Engineering, ASCE, June 2012, pp 789-801.

[6] Hubbard, C., and Salem, O. (2018). *Experimental determination of pull-out strength of threaded steel rods mechanically fastened into glulam beam sections*. CSCE 2018 Fredericton Annual Conference, Fredericton, Canada, 13-16 Jun. 2018.

[7] Hunger, F., Stepinac, M., Rajčič, V., and Kuilen, J. W. G. (2016). *Pull-compression tests on glued-in metric thread rods parallel to grain in glulam and laminated veneer lumber of different timber species*. European Journal of Wood and Wood Products, 12 Jan. 2016, pp 379-391.

[8] Nordic Structures. (2015). *Design Properties of Nordic Lam. In* Technical Note S01. Nordic Structures, Canada, 2015.

[9] Oh, J. (2016). *Timber Moment Connections Using Glued-in Steel Rods*. Masters thesis. UBC, Vancouver, Canada, April 2016.

[10] Petrycki, A., and Salem, O. (2017). *Experimental Fire Testing of Concealed Steel-Glulam Timber Semi-Rigid Bolted Connections*. 6th International Conference on Engineering Mechanics and Materials, Vancouver, Canada, 31 May-3 Jun. 2017.

[11] Steiger, R., Gehri, E., and Widmann, R. (2006). *Pull-out strength of axially loaded steel rods bonded in glulam parallel to the grain*. Materials and Structures, 19 Oct. 2006, pp 69-78.

SUMMARY OF THE INVENTION

According to one aspect of the present invention there is provided a method of connecting a beam to a supporting body having an upright supporting surface in which the beam is formed of wood material and extends longitudinally between end faces at opposing ends of the beam, the method comprising:

providing a fastener bore extending longitudinally into the beam from an open end of the fastener bore at one of the end faces of the beam to a terminal end of the fastener bore embedded within the beam;

providing an access bore oriented transversely to the fastener bore in an intersecting relationship with the fastener bore so as to extend inwardly into the beam from an open end of the access bore at an exterior surface of the beam to a terminal end of the access bore embedded within the beam;

abutting said one of the end faces with the upright supporting surface of the supporting body;

mounting a connector rod in the supporting body to protrude outwardly from an upright supporting surface of the supporting body and into the fastener bore in the beam;

mounting a mating connector within the access bore; and forming a mechanical connection between the mating connector and the connector rod so as to fasten the end face of the beam against the upright supporting surface.

Preferably said mechanical connection is a threaded connection between the connector rod in the fastener bore and the mating connector in the access bore.

The method preferably further includes plugging the access bore with a plug of heat insulating material, for example a plug formed of wood material similar to the wood material forming the beam.

According to another aspect of the present invention there is provided a beam connecting system comprising:

a connector rod;

a mating connector arranged to form a mechanical connection to the connector rod;

a supporting body having an upright supporting surface on a first side of the supporting body which receives a portion of the connector rod mounted thereon such that the connector rod protrudes from the upright supporting surface of the supporting body, the system comprising:

a beam formed of wood material and extending longitudinally between end faces at opposing ends of the beam;

a fastener bore extending longitudinally into the beam from an open end of the fastener bore at one of the end faces of the beam to a terminal end of the fastener bore embedded within the beam;

an access bore oriented transversely to the fastener bore in an intersecting relationship with the fastener bore so as to extend inwardly into the beam from an open end of the access bore at an exterior surface of the beam to a terminal end of the access bore embedded within the beam;

said one of the end faces of the beam being abutted with the upright supporting surface of the supporting body such that the fastener bore receives the connector rod extending longitudinally therethrough;

the access bore receiving the mating connector therein;

the mating connector and the connector rod forming said mechanical connection so as to fasten the end face of the beam against the upright supporting surface.

According to another aspect of the invention there is provided a beam connecting system using a connector rod, a mating connector arranged to form a mechanical connection to the connector rod, and a supporting body having an upright supporting surface on a first side of the supporting body which receives a portion of the connector rod mounted thereon such that the connector rod protrudes from the upright supporting surface of the supporting body, the system comprising:

a beam formed of wood material and extending longitudinally between opposing ends of the beam;

an end face at one of the ends of the beam arranged for abutment with the upright supporting surface;

a fastener bore extending longitudinally into the beam from an open end of the fastener bore at the end face of the beam to a terminal end of the fastener bore embedded within the beam;

the fastener bore being arranged for alignment with the connector rod protruding from the upright supporting surface to receive the connector rod extending longitudinally therethrough;

an access bore oriented transversely to the fastener bore in an intersecting relationship with the fastener bore so as to extend inwardly into the beam from an open end of the access bore at an exterior surface of the beam to a terminal end of the access bore embedded within the beam;

the access bore being arranged to receive the mating connector therein such that the mating connector and the connector rod are capable of forming said mechanical connection so as to fasten the end face of the beam against the upright supporting surface.

The present invention which uses a mechanically fastened connection of embedded rods to fasten the ends of a beam provides a practical solution to the epoxy problem at elevated temperatures. Such a connection can be easily assembled in the field, eliminating the common possibility of bond failure in the glued-in rods, as well as avoiding the epoxy deterioration issues at elevated temperatures.

Preferably the connector rod is a threaded rod and the mating connector is a threaded nut.

Preferably a plug of heat insulating material is arranged to occupy at least a portion of the access bore. The plug may be further arranged to fully enclose the access bore in a flush mounted relationship with the exterior surface of the beam. The heat insulating material of the plug preferably comprises wood.

When the connector rod and the mating connector are formed of metal, preferably all of the metal used in connecting the beam to the supporting body is fully embedded and surrounded by wood material.

The beam preferably comprises a glue laminated timber.

The fastener bore may be laterally centered between upright side surfaces of the beam. The fastener bore may also be spaced apart from each of a top surface and a bottom surface of the beam by a distance which is substantially equal to or greater than a distance of the fastener bore to each of two upright side surfaces of the beam.

When the supporting body comprises a column of wood material, the connector rod is preferably fully embedded within both the beam and the supporting body so as to be fully surrounded by wood material.

The beam may comprise a cantilever beam. Alternatively, the beam may be supported against a supporting body at both ends of the beam, in which each end of the beam includes a fastener bore and an access bore associated therewith for receiving a connector rod and a mating connector as described above.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 9:
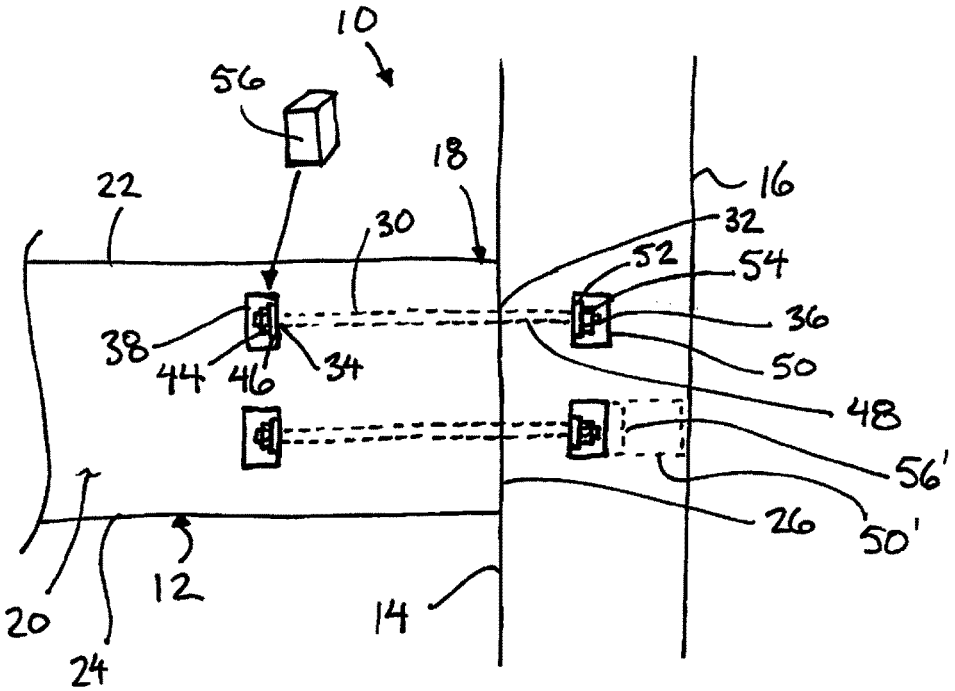
FIG. 9 is a schematic elevational view of a connection between a first end of a beam and a supporting body.
Figure 10:
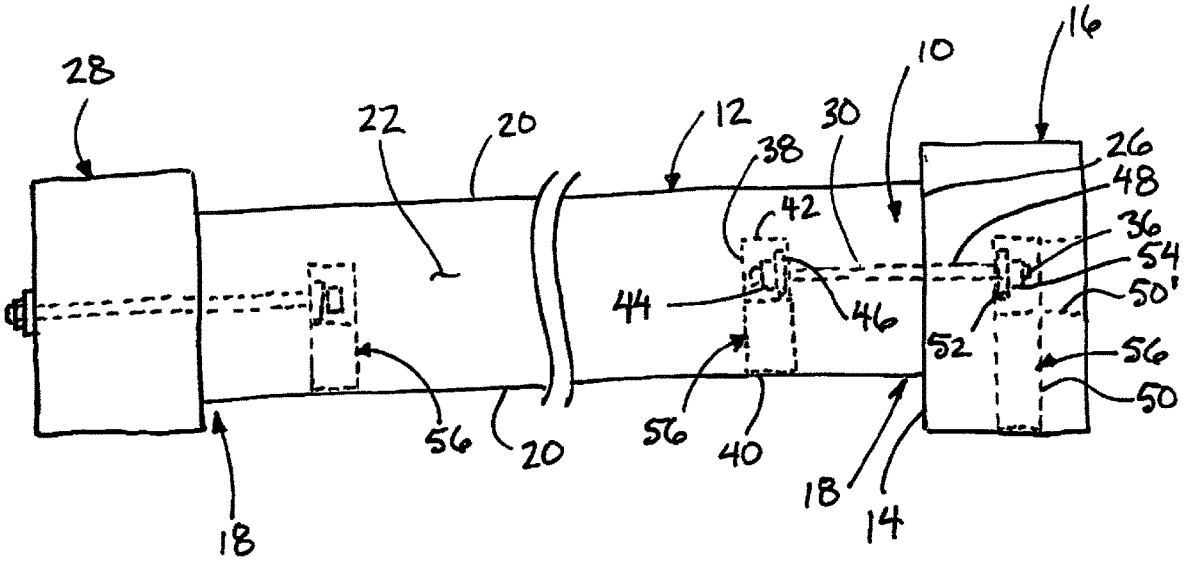
FIG. 10 is a top plan view of the beam according to FIG. 9 showing a second end of the beam connected to a column.

Referring initially to FIGS. 9 and 10 there is illustrated a beam connecting system generally indicated by reference numeral 10. The system 10 is particularly suited for connecting the end of the beam 12 to an upright supporting surface 14 of a supporting body 16, for example a column or wall or other structural member.

In the illustrated embodiment, the beam 12 comprises a glue laminated timber which is elongate in a longitudinal direction between two opposing ends 18 of the beam. The beam further includes two side surfaces 20 which are parallel and upright in orientation so as to extend in the longitudinal direction and so as to define the overall width of the beam in a lateral direction. The beam further includes a top surface 22 and a bottom surface 24 which are also parallel to one another while extending horizontally in the longitudinal direction of the beam to define the overall height of the beam therebetween. Typically, the beam is configured such that the height is greater than the width. The beam also includes two end faces 26 which are oriented perpendicularly to the longitudinal direction of the beam at respective ones of the opposing ends 18. Each end face is generally rectangular in shape.

In the illustrated embodiment, a first end of the beam 12 is connected to a first supporting body 16 using the system 10 of the present invention. The opposing second end of the beam 12 may be a free end in the instance of a cantilevered beam, or may be connected to a second supporting body 28 in a manner which is substantially identical to the connection to the first supporting body 16 as described herein.

At each end of the beam, one or more mechanically fastened connections are provided between the beam and the supporting body. At each fastened connection there is provided a fastener bore 30 extending into the beam in the longitudinal direction from an open end 32 at the end face 26 of the beam to a terminal end 34 embedded internally within the beam. The fastener bore is spaced radially inwardly from both side surfaces, the top surface and the bottom surface of the beam. An internal diameter of the fastener bore is approximately equal to or only slightly greater than the outer diameter of a connector rod 36 of the fastened connection. The connector rod comprises an elongate threaded shaft having a first portion embedded within the corresponding supporting body 16 and a second portion embedded in the beam 12.

To secure the connector rod 36 within the beam, an access bore 38 is formed in the beam in association with the fastened connection in which the access bore is oriented perpendicularly to and in an intersecting relationship with the respective fastener bore 30 with which it is associated. More particularly, the access bore 38 is open to an exterior surface of the beam at one of the side surfaces 20 such that the access bore extends in a lateral direction inwardly from an open end 40 of the access bore at the side surface of the beam to a terminal end 42 of the access bore which is embedded within the beam in open communication with the terminal end of the fastener bore.

The access bore 38 is suitably sized to receive a mating connector 44, for example a threaded nut which forms a mechanical threaded connection with the connector rod. A washer 46 is also provided about the connector rod within the access bore 38 for cooperation with the threaded nut in a conventional manner.

The fastener bore is typically laterally centred between the two side surfaces of the beam when the fastened connections are provided in a single vertical column within the beam at each end of the beam according to the illustrated embodiment. The fastener bores are also evenly spaced apart such that the vertical space between two adjacent fastener bores as well as the vertical space from each fastener bore to each of the top and bottom surfaces of the beam are arranged to be greater than the lateral distance of the fastener bore to either side surface of the beam. This arrangement ensures the greatest degree of heat insulation on all sides of the connector rod received within the fastener bore by the wood material of the beam in the mounted configuration of the beam. The length of the end portion of the connector rod embedded within the beam corresponds approximately to the longitudinal length of the fastener bore which is typically much greater than the distance of the fastener bore to any side surface, top surface or bottom surface of the beam in a radial direction to the bore.

In further embodiments, the fastened connections between the end of the beam 12 and the supporting body 16 may include two or more fastened connections laterally spaced apart in one or more vertically spaced apart rows of fasteners as may be desired. In each instance, each of the fastened connections is provided at a suitable space from all of the side surfaces, top surface and bottom surface of the beam to surround the fastened connections with a suitable thickness of heat insulating wood material.

The first portion of the connector rod 36 is secured within the supporting body 16 typically in the same manner as the second portion of the rod within the beam. More particularly, the supporting body 16 also includes a fastener bore 48 for alignment with the corresponding fastener bore 30 of the beam in which the fastener bore extends inwardly into the body from an open end of the fastener bore at the upright supporting surface of the body to a terminal end of the fastener bore embedded within the supporting body. An access bore 50 is also provided in the supporting body to be oriented perpendicularly to the fastener bore in an intersecting relationship therewith by extending inwardly from an open end of the access bore at an exterior surface of the supporting body 16 to a terminal end of the access bore in open communication with the terminal end of the fastener bore 48. The access bore is suitably sized to receive a washer 52 and a mating connector 54 such as a threaded nut for forming a mechanical threaded connection with the connector rod 36. The fastener bore 48 has an internal diameter which is proximally equal to or greater than the outer diameter of the connector rod to closely receive the threaded shaft therein with minimal tolerance similar to the fastener bore in the beam.

In a mounted arrangement of the connector rod within the supporting body 16, the connector rod protrudes from the upright supporting surface 14 of the body for insertion into the corresponding fastener bore in the end face of the beam. Tightening the nuts at opposing ends of each connector rod effectively clamps the corresponding end face of the beam in tight abutment against the upright supporting surface 14 of the supporting body 16.

In further embodiments, the fastener bores 48 in the supporting body may be fully penetrated through the supporting body to a second upright surface at the rear of the supporting body which is parallel and opposite from the first upright surface against which the end face of the beam abuts. As shown by the connection of the beam to the second supporting body 28 in FIG. 10, the connector rods in this instance may pass fully through the supporting body so that the washer 52 and nut 54 are instead secured externally of the supporting body but opposite from the beam connection. In this instance no access bore 50 is required in the supporting body.

In yet further embodiments, the access bore in the supporting body at each fastened connection may alternatively comprise a parallel access bore 50' which is oriented parallel to, or substantially coaxial and in line with, the corresponding fastener bore 48. The parallel access bore 50', represented as an alternative arrangement in broken line in FIGS. 9 and 10, is open to the rear side of the supporting body 16 that is opposite to the upright supporting surface 14 of the supporting body 16 against which the end face of the beam is abutted. The parallel access bore 50' (similar to previous embodiments of the access bore 50) has a much larger diameter or overall dimensions transverse to the axial direction of the bore than the corresponding fastener bore such that the parallel access bore 50' functions as a counterbore to the fastener bore 48 to provide a shoulder surface against which the washer and/or nut can be abutted to anchor the connector rod relative to the supporting body. When using a parallel access bore 50', the nut 54 and washer 52 are inserted in the usual manner to allow a threaded connection to the connector rod at an embedded location within the supporting body, followed by enclosing the access bore with a plug 56' of heat insulating wood material similarly to the plug 56 used to plug other access bores as described in the following.

To complete each fastened connection, a suitable plug 56 is provided which fully occupies the access bore 38 from the connection of the mating connector 44 to the open end 40 of the bore. More particularly, the plug 56 is shaped to have a cross-section matching the cross-section of the access bore 38 so as to be laterally slidable into the access bore while fully closing the open end of the access bore. The plug is typically mounted so as to be substantially flush with the corresponding side surface of the beam at the exterior side of the plug. The plug 56 is formed of a heat insulating material, for example a wood material similar to the wood material forming the beam. In this manner, the metal components of the connector rod, the mating connector 44, and the washer 46 are all fully embedded within the beam and fully surrounded by the heat insulating effects of the surrounding wood material to greatly increase the fire resistance of the fastened connection of the beam 12 to the supporting body 16.

Similar plugs 56 are also provided in the access bores within the supporting body 16 in the same manner.

In use, the fastener bores 30 in the beam are typically drilled in the longitudinal direction from the end of the beam and corresponding fastener bores 48 are drilled into the supporting body 16. The corresponding access bores may be drilled, chiseled, or otherwise machined into the material of the beam and of the supporting body 16. Typically, the supporting body is also formed of wood material, for example a glue laminated timber. The formation of the fastener bores and the corresponding access bores may be done at a separate manufacturing location, or may be performed on site where the beam connection to the supporting body is intended to take place. At the assembly site, the connector rods are inserted into the corresponding fastener bores at each fastened connection and the corresponding washers and nuts are attached to the connector rods so that tightening of the nuts forms a secure threaded connection between the ends of the beam and the corresponding supporting bodies. A plug 56 is then inserted into each access bore such that the entirety of the metal components of each fastened connection are fully embedded and surrounded by wood material to provide a degree of heat insulation to the metal components for increasing the fire resistance thereof.

As described in the following, an experimental study was undertaken to investigate the behaviour of glulam beam end connections, utilizing mechanically-fastened threaded steel rods and subjected to standard fire. For the research, four full-size glulam beam connections, each utilized two concealed threaded steel rods inserted into the end of the beam section near the top and bottom sides, were experimentally examined. Two small holes carved into one side of the beam, where the rod ends are inserted, were employed to insert a steel washer and nut, in each hole, to mechanically fasten the threaded rod embedded ends. The holes were then plugged with two tightly-fitting glulam plugs that were glued in place to provide fire protection to the metal components. The main study parameter was the rod embedment length; where 200 mm and 250 mm embedment lengths with the use of same 38.1-mm (1.5 inch) square washer were experimentally examined to investigate their effects on the fire resistance of the beam end connection. A design load reflecting the connection's ultimate design moment-resisting capacity was applied at the end of the cantilevered beam that was then exposed to elevated temperatures that followed CAN/ULC-S101 standard time-temperature curve. Results revealed that the beam connection of 200 mm embedment length lasted about 58 minutes in fire; whereas the connection of 250 mm embedment length lasted about 62 minutes.

The glulam beam sections (135 mm×314 mm) used in the test assemblies were S-P-F, comprised of 90% black spruce. The beam sections were manufactured to meet the 24F-ES/NPG stress grade with architectural appearance grade. The individual lamina stocks that were used to build up the beam sections measured 24 mm×47 mm. The laminations were finger jointed at their ends and glued together in horizontal and vertical layers. Since the beam sections were manufactured to provide symmetrical alignment of the laminations along the cross-sectional width and depth, the beam sections had a homogeneous layup. The main mechanical design properties of the glulam sections are listed in Table 1, below.

TABLE 1

Mechanical properties of glulam beam sections (Nordic Structures, 2015)

| Property | Strength (MPa) |
|---|---|
| Bending moment, $F_b$ | 30.7 |
| Longitudinal shear, $F_v$ | 2.5 |
| Compression perpendicular to grain, $F_{cp}$ | 7.5 |
| Compression parallel to grain, $F_c$ | 33.0 |
| Tension parallel to grain, $F_t$ | 20.4 |
| Tension perpendicular to grain, $F_{tp}$ | 0.51 |
| Modulus of elasticity, E | 13100 |

The threaded rods used in the experiments had a diameter of 19.05 mm (¾ inch), length of 910 mm, and stress grade of SAE J429-Grade 2. Using a band saw, the rods were cut to 470 mm and 520 mm for the test assemblies with 200-mm and 250-mm embedment lengths, respectively. The remaining cut off rod sections was used as tension coupons and thus was tested on the Tinus Olsen Universal Testing Machine at Lakehead University's Civil Engineering Structures Laboratory to confirm the stress grade of the rods. The average tensile force exerted by the rods were recorded at 90 kN, confirming the rods stress grade.

The washers used for the experiments were fabricated from a 12.7-mm (½ inch) thick steel flat bar with a stress grade of 300 W, as specified by CSA G40.20-04/G40.21-13. There were eight washers fabricated; all had dimensions of 38.1 mm×38.1 mm (1.5 inch×1.5 inch). A 20.6-mm (13/16") diameter hole was drilled in the centre of each washer.

Figure 1A:
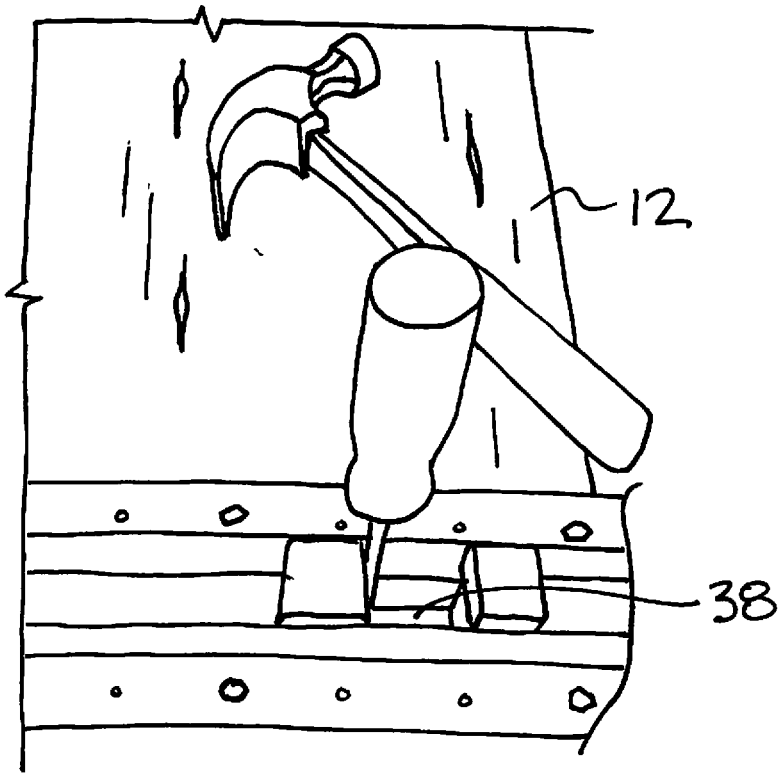
FIG. 1*a* is a beam section being chiseled to form the access bore.
Figure 1B:
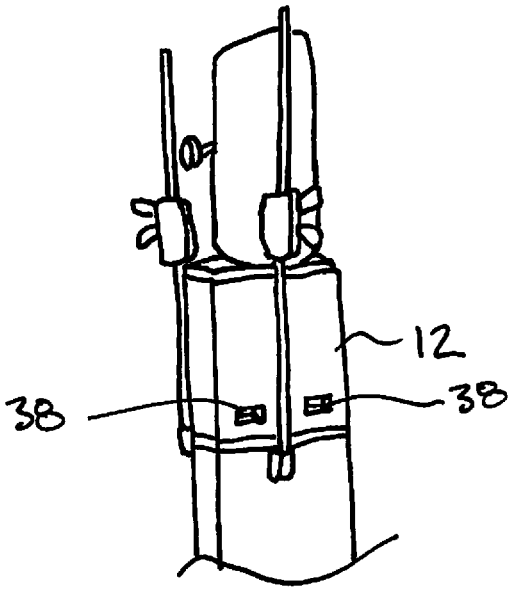
FIG. 1*b* is a beam section being drilled to form the fastener bore.

The two threaded rods employed in the glulam beam pilot connection configuration had embedment lengths of either 200 mm or 250 mm. Every beam section had a line marked perpendicular to the wood grain at the required embedment length, and a line marked parallel to the grain down the centre of the 314 mm wide face of the beam. Two lines were then marked parallel to the grain, and each one was offset 80 mm on either side of the centre line. Next, two little rectangles were marked directly below the embedment length line and centred on each of the offset lines. Rectangles measured 41.3-mm (1⅝ inch) wide and 30-mm thick to accommodate the washer and nut thicknesses. All rectangles were then carved out into a rectangular prism using wood chisels to a depth of approximately 87 mm, as shown in FIG. 1*a*. A 20.6-mm (13/16") diameter hole was then drilled in line and centred of each carved out hole on the 314-mm wide face and centred on the 135-mm wide face at the end of the beam section to the required embedment length using a precise portable drilling station as shown in FIG. 1*b*.

The purpose of this research is to confirm that a fully concealed glulam beam-column connection sized at 135 mm×314 mm high can achieve a one-hour fire resistance rating. The experimental testing of the pull-out strength of an individual steel rod mechanically fastened into a glulam section was conducted and documented (Hubbard and Salem, 2018). In the prior study conducted by the authors, the average pull-out tensile force of the threaded rod mechanically fastened into glulam beam section with 200 mm embedment length and 38.1-mm (1.5-inch) wide square washer was recorded at 69 kN; whereas the average tensile force was recorded at 79 kN for the connections with 250 mm embedment length.

The threaded steel rod in glulam beam end connections was also tested at ambient temperatures prior to conducting the fire resistance tests presented herein. Having the top steel rod subjected to tensile force and the lower part of the wood section under compression, the connection moment-resisting capacity was calculated at 10.0 kN·m, using principles of mechanics along with the design provisions of CAN/CSA 086-14. The ambient temperature tests performed on the connection assemblies with 200-mm and 250-mm embedment lengths revealed that both assemblies have an average maximum moment-resisting capacity of about that surpassed the ultimate design moment-resisting calculated capacity.

Figure 2:
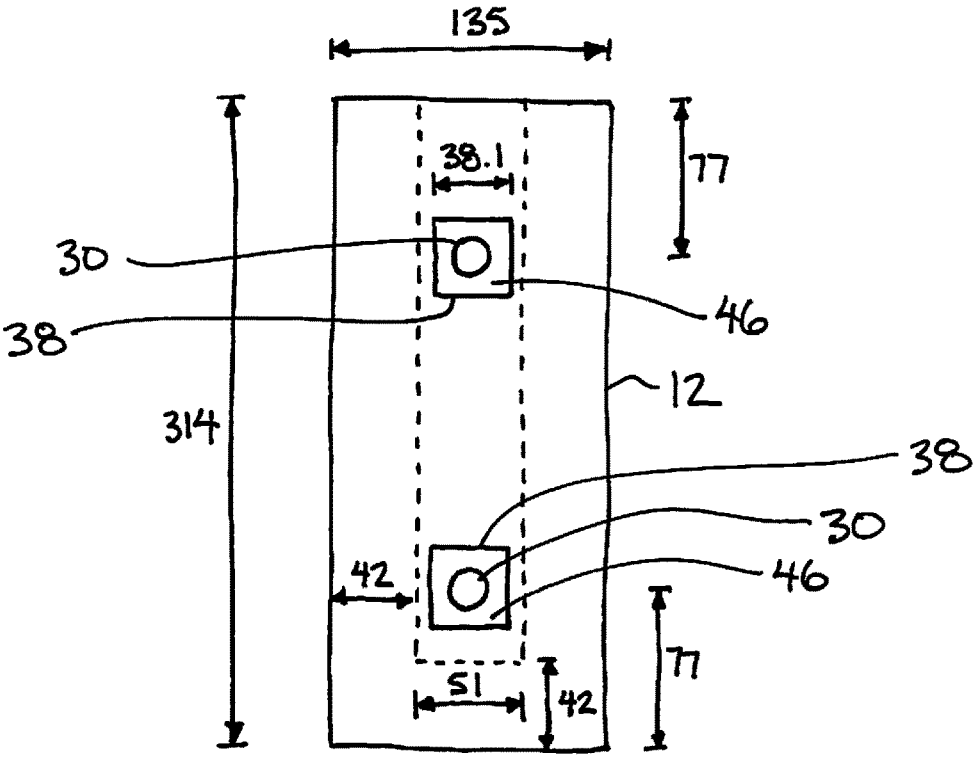
FIG. 2 is a sectional view through the beam along a plane perpendicular to a longitudinal direction of the beam.

The nominal char rate of the glulam sections experimentally tested in the research project presented herein was 0.7 mm/min (Nordic Structures 2015). Therefore, after one-hour (60 minutes) fire exposure, a char layer of about 42-mm thick (corresponding to the char rate of the material of the beam as noted above multiplied by a prescribed fire resistant duration of 60 minutes) can be formed on the bottom and the two sides of the glulam beam as shown in FIG. 2. Considering the width of the washer is 38.1 mm (1.5 inch) and its location laterally centred within the beam width, the beam should still have about 6.5 mm of wood protection at the washers' sides due to the minimum thickness of the beam between the washer and the exterior surfaces of the beam on all sides of the washer as shown in FIG. 2 being greater than the calculated char layer noted above. The tests matrix with the corresponding fire resistance predicted times to failure is presented in Table 2.

TABLE 2

Threaded rod in glulam beam end connection tests matrix

| Test configuration | Test replicates | Embedment length (mm) | Washer size (mm) | Safe design load applied (kN · m) | Predicted time to failure (min) |
|---|---|---|---|---|---|
| Test 200-1.5 | 2 | 200 | 38.1 | 10.0 | 60 |
| Test 250-1.5 | 2 | 250 | 38.1 | 10.0 | 60 |

Figure 3A:
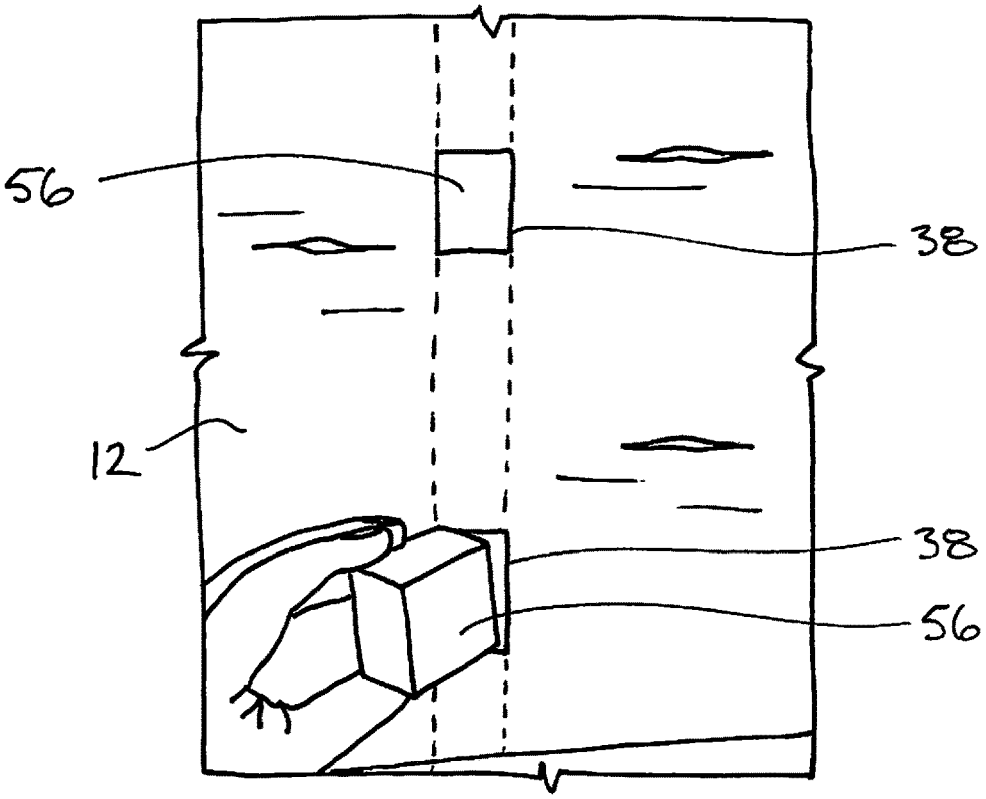
FIG. 3*a* illustrates placement of heat insulating blocks into the access bores of the beam.
Figure 3B:
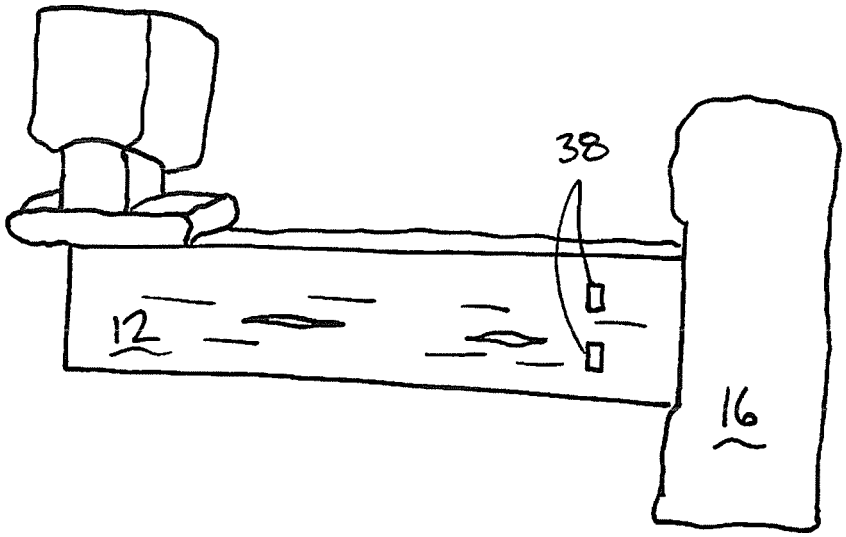
FIG. 3*b* illustrates a general fire resistance test setup for testing the beam as described herein.

Each test assembly was fixed to a strong steel support using two threaded steel rods. The carved cut offs on the beam face, which accommodated the steel rods' nuts and washers, were then plugged with a small form fitting chunk of glulam and glued in place with wood glue as shown in FIG. 3*a*. Both, the glulam beam and the fire-protected support were placed inside the large-size fire testing furnace accommodated at Lakehead University's Fire Testing and Research Laboratory (LUFTRL), as shown in FIG. 3*b*. The beam top side was fire protected using a 1-inch thick layer of ceramic fibre blanket insulation to simulate the existence of a slab on top of the beam. Test beams were loaded to 100% of the calculated design moment-resisting capacity of the weakest connection configuration. A hydraulic jack mounted to the strong loading steel structure that surrounded the furnace was used to apply the transverse load on the beam via an insulated steel post which was installed through an opening in the furnace roof. One draw-wire displacement transducer was installed outside the furnace and attached to a ceramic rod that was inserted through the furnace roof at 200-mm distance away from the face of the steel support to capture the vertical displacements of the beam during fire resistance testing. Another draw-wire displacement transducer was installed outside of the furnace and attached to the insulated steel post to measure the vertical displacements of the beam free end. The measured displacements from both transducers were used to determine the rotation of the beam end connection. As for thermal measurements of the wood and steel components of the connections during fire tests, twelve metal-shielded k-type thermocouples were placed on each specimen as detailed in FIG. 3*b*. Six thermocouples were installed in the wood section on the beam front face and the other six mirrored on the back face of the beam.

Figure 4:
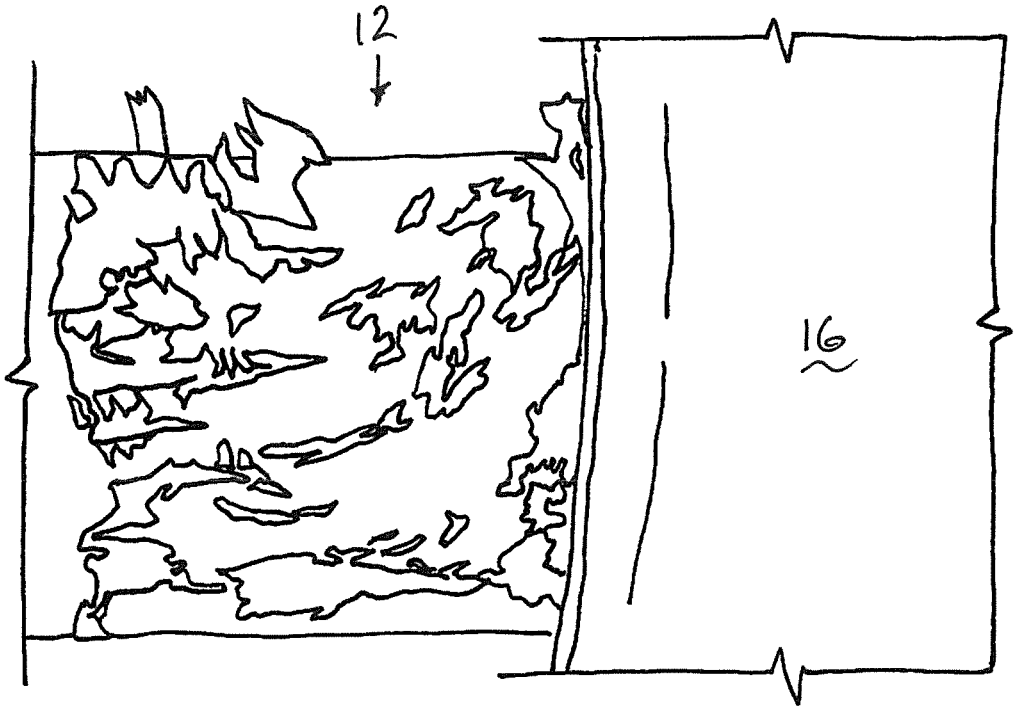
FIG. 4 shows a general test assembly that underwent fire exposure after about 30 minutes with no noticeable deflection.

As per CAN/CSA-S101, the total transverse load was applied in 25% increments at least 30 minutes before the test assembly was exposed to CAN/ULC-S101 standard fire time-temperature curve. Deflections of each test assembly were measured during fire testing until the test assembly could no longer hold the applied load, or the test assembly reached the maximum measurable amount of deflection, at which the test was terminated. FIG. 4 shows a general test assembly that underwent fire exposure after about 30 minutes with no noticeable deflection.

Figure 5:
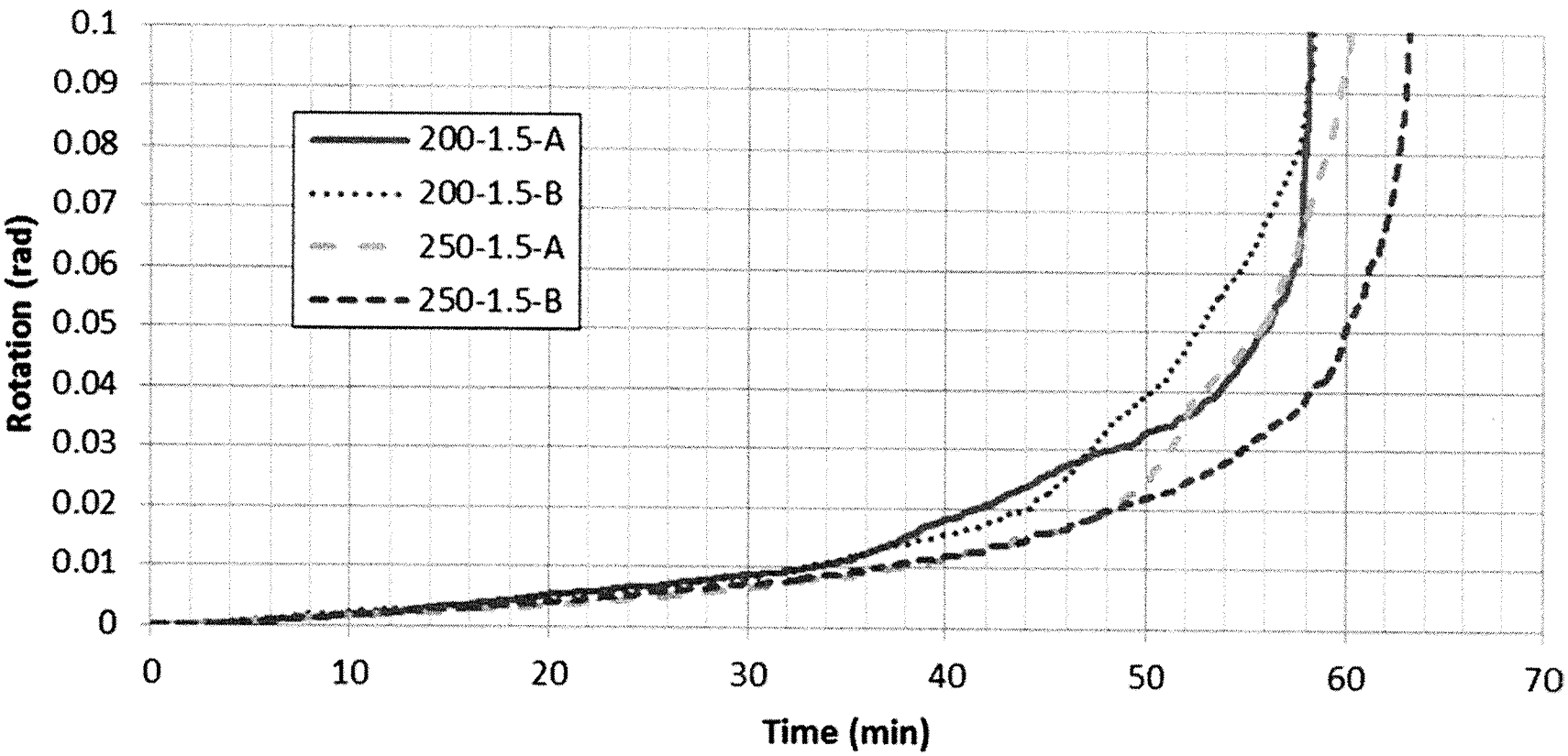
FIG. 5 graphically represents the full time-rotation relationships for all fire resistance tests described in the following.

The test specimens' failure criterion that was also indicated on the time-rotation curves was determined to be a maximum beam end connection rotation of 0.1 radians. It was also observed that the test assemblies underwent two different trends of increased rotations with time in all four fire resistance tests. The connection rotations slightly increased in a linear trend during the first half of the test time (about 30 minutes). Whereas for the second half of the test time, the beam connection's rotations increased exponentially over time until failure. Both rotation trends are shown in FIG. 5. All linear trends of the four fire tests are very similar; however, the experimental results show that the connection configurations with 250-mm embedment length were stiffer than those of 200-mm embedment length.

Figure 6:
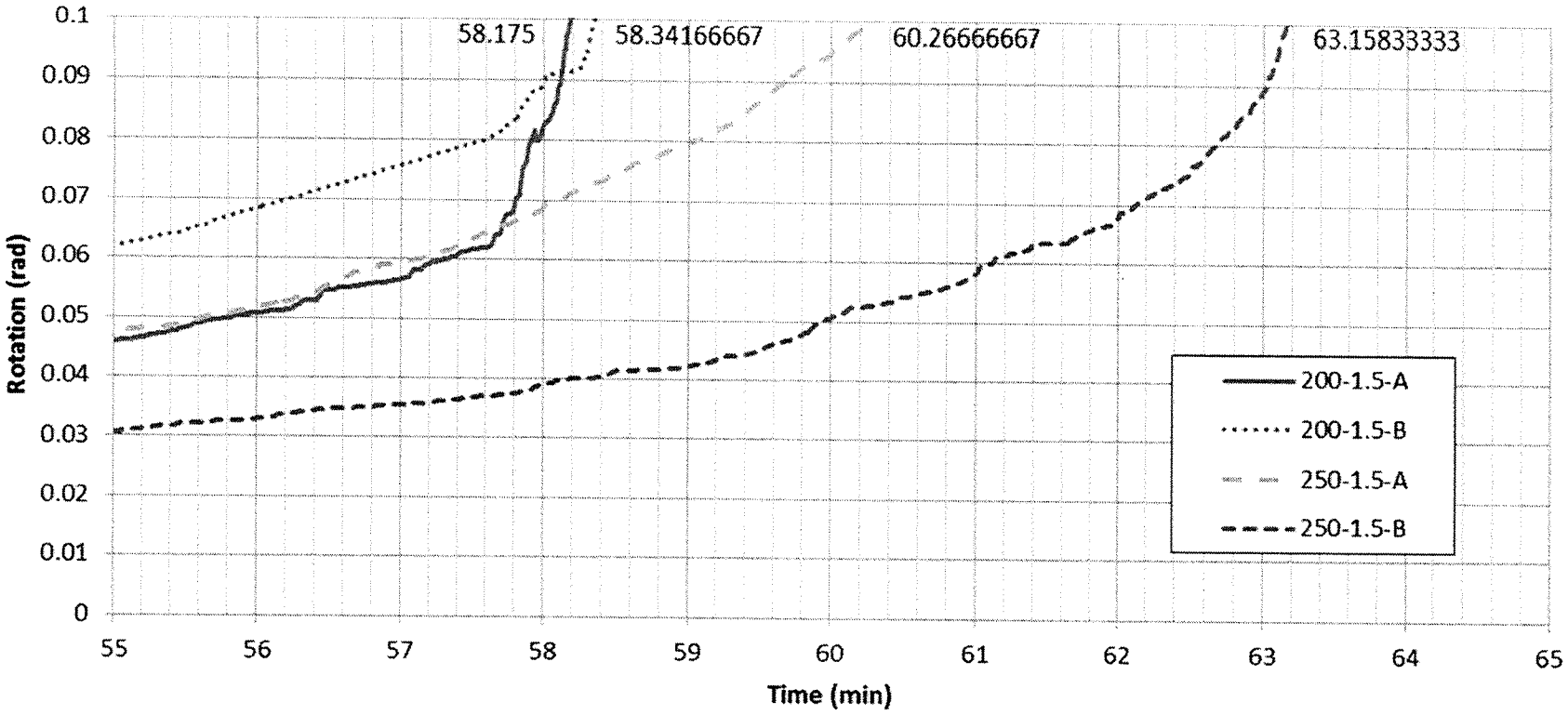
FIG. 6 graphically represents the time-rotation relationships for all fire resistance tests throughout the last 10 minutes.

The last 10 minutes of the fire tests show a better representation of the failure modes and exact fire resistance time, as shown in FIG. 6. Fire resistance tests showed that the 200-mm embedment length connections failed just after about 58 minutes of fire exposure. The failure in the two 200-mm embedment length connections was mainly splitting in the wood section along the steel rod as shown by the sharp increase in the connection rotation just before the 0.1 radian rotation failure criterion was achieved. Also, the termination of these two fire tests was due to the fact that the split beam section could no longer hold the full applied load. The other two fire resistance tests conducted on the 250-mm embedment length connections failed just after 60 minutes. The failure of these two 250-mm embedment length connections was mainly due to the steel rod bending and deforming from the very elevated temperatures as proven by the gradual increase in the connection rotation just before the 0.1 radian failure criterion was achieved. The termination of these two fire resistance tests was due to the beam reaching the maximum measurable amount of deflection. It was concluded that the 250-mm embedment length beam connections were able to sustain the applied design load considerably longer than the 200-mm embedment length beam connections at elevated temperatures that followed CAN/ULC-S101 standard fire time-temperature curve. The conclusion was mainly due to the fact that the longer steel rods had more contact with the wood, allowing a gradual increase of the connection's rotation along with the steel rod being bended instead of having the wood snapped along the shorter steel rod.

Figure 7A:
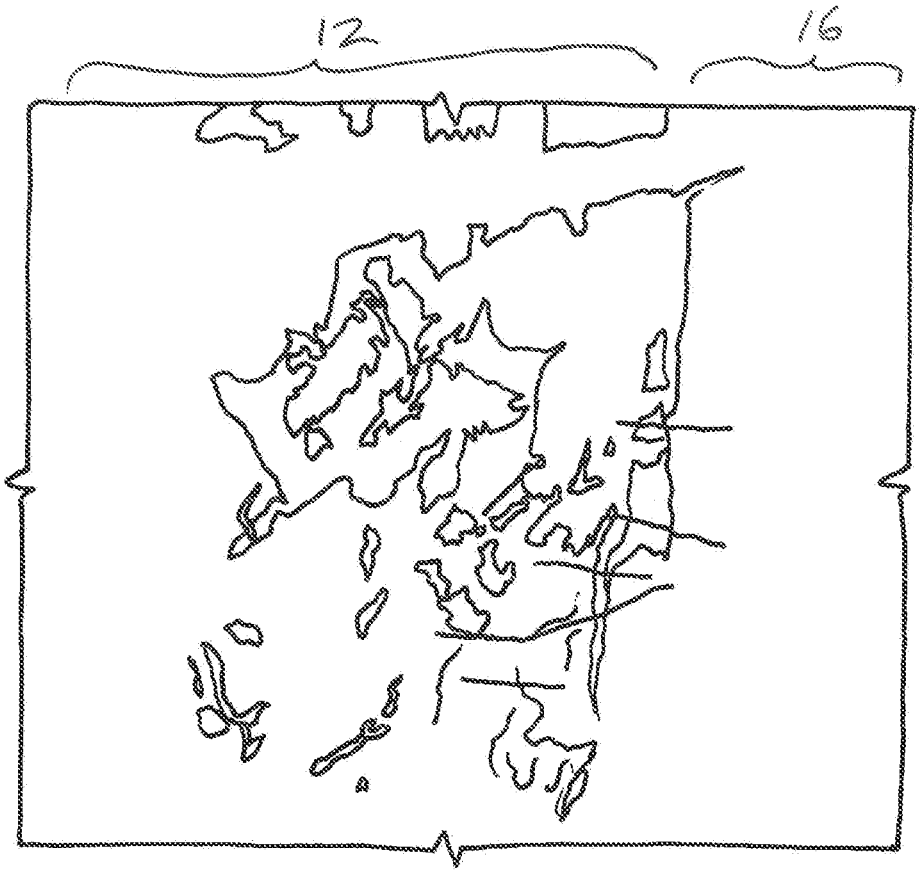
FIGS. 7*a* and 7*b* show (i) results of a test with a ¾-inch diameter rod having a 200 mm embedded length and a 1.5-inch square washer, and (ii) the resulting rods after failure.
Figure 7B:
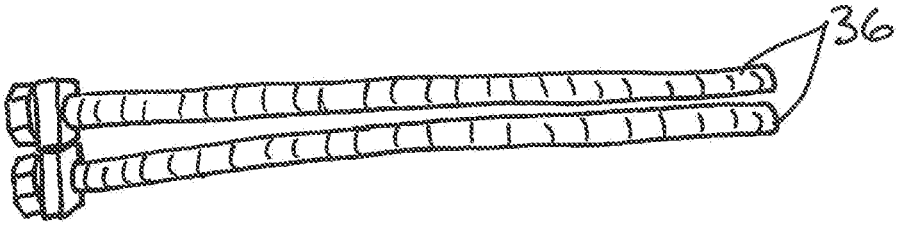

The pictures shown in FIGS. 7*a* and 7*b* are in good agreement with the graphed results presented in FIG. 6; where the 200-mm embedment length connections failed in a brittle failure mode due to the wood splitting as shown in FIG. 7*a*. The wood splitting caused the test to be terminated due to the connection not being able to hold the applied full design load. With the wood splitting, the top steel rod did not exhibit noticeable deformations; whereas the bottom steel rod experienced slightly more deformations compared to the top one, as shown in FIG. 7*b*.

Figure 8A:
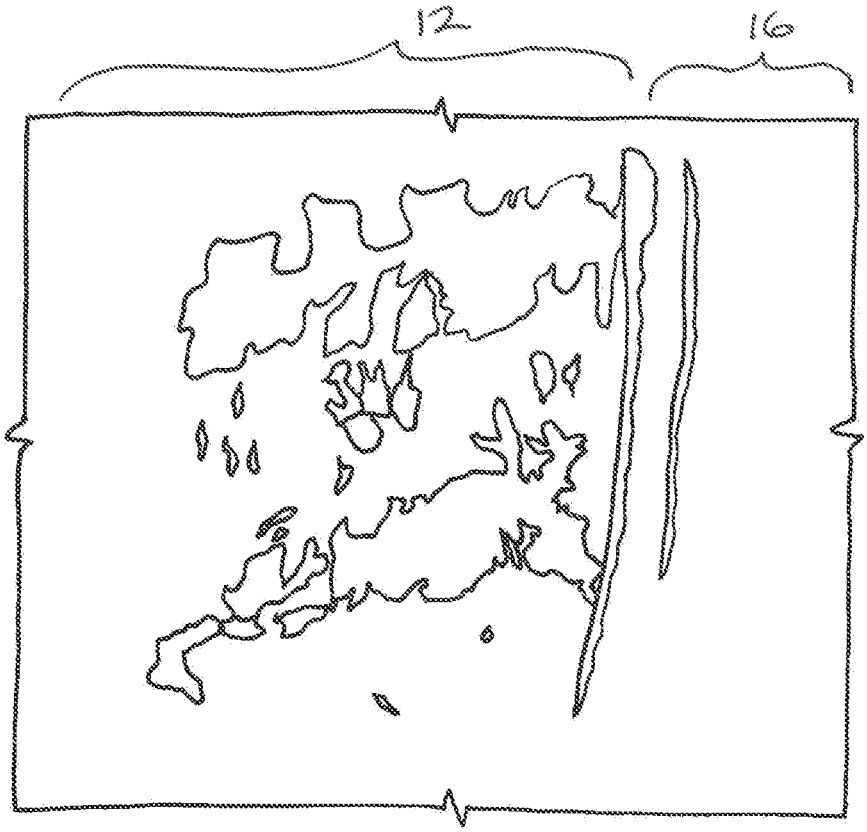
FIGS. 8*a* and 8*b* show (i) results of a test with a ¾-inch diameter rod having a 250 mm embedded length and a 1.5-inch square washer, and (ii) the resulting rods after failure.
Figure 8B:
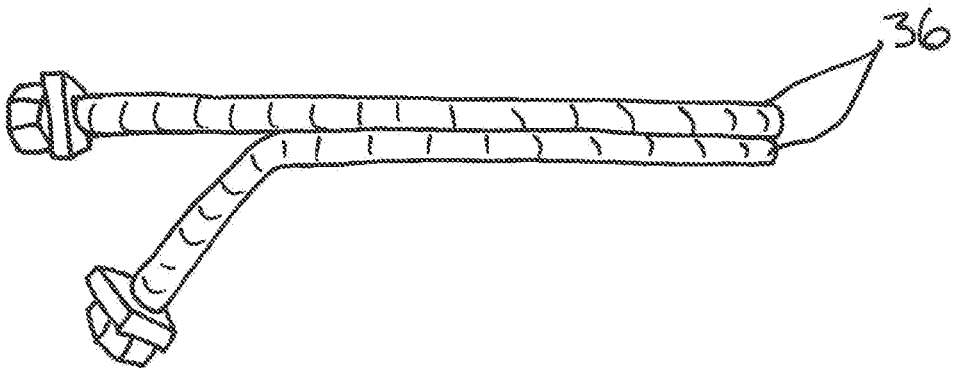

The pictures shown in FIGS. 8*a* and 8*b* are also in excellent agreement with the graphed results presented in FIG. 6; where the failure of the 250-mm embedment length connections was a relatively ductile failure due to the steel rods deformed as shown in FIG. 8*b*. The steel rods deforming caused the test to be terminated due to the beam reaching the maximum measurable amount of deflection. Also, with the longer rod embedment length, there was more wood to resist the shear forces imposed by the top steel rod; therefore, allowing the steel rods to be considerably heated causing the bottom rod to deform excessively, as shown in FIG. 8*b*.

In general, increasing the embedment length from 200 mm to 250 mm increased the beam end connection's fire resistance time from just under an hour, at an average of 58.25 minutes, to just over an hour, at an average of 61.75 minutes. Table 3 provides a summary of the four fire resistance tests' results.

TABLE 3

Summary of results of the four fire resistance tests on glulam beam end connection assemblies

| Test No. | Embedment length (mm) | Washer size (mm) | Fire resistance time (min) | Average fire resistance time (min) |
|---|---|---|---|---|
| 200-1.5-A | 200 | 38.1 | 58.2 | 58.25 |
| 200-1.5-B | 200 | 38.1 | 58.3 | |
| 250-1.5-A | 250 | 38.1 | 60.3 | 61.75 |
| 250-1.5-B | 250 | 38.1 | 63.2 | |

Based on the experimental outcomes and the analysis of the fire resistance test results conducted afterwards, a few conclusions have been driven, and are listed as follows; (i) Increasing the embedment length from 200 mm to 250 mm increased the fire resistance time of the glulam beam end connection from just under a one-hour fire resistance rating to just over a one-hour fire resistance rating; (ii) The 250-mm embedment length connection exhibited a relatively ductile failure compared to that of the 200-mm embedment length, which failed mainly due to wood splitting eventually in the fire testing; (iii) Any fire exposed steel components would cause the beam end connection to fail faster in fire; therefore, the protection from the wood section greatly helps in enhancing the fire resistance of the connection configurations utilized threaded steel rods that were mechanically fastened into the glulam beam sections compared to similar connection configurations with steel plates and fire-exposed bolts.

Since various modifications can be made to the beam end connection detailed in this invention application and since many apparently widely different embodiments of same made, it is intended that all matter contained in the accompanying specification shall be interpreted as illustrative only and not in a limiting sense.

The invention claimed is:

1. A method of forming a fire resistant, moment-resisting connection between a beam and a supporting body having an upright supporting surface in which the beam is formed of wood material and extends longitudinally between end faces at opposing ends of the beam and in which the moment-resisting connection is resistant to fire for a prescribed fire resistant duration when loaded to a calculated moment-resisting capacity of the connection, the method comprising:

providing a fastener bore extending longitudinally into the beam from an open end of the fastener bore at one of the end faces of the beam to a terminal end of the fastener bore embedded within the beam;

providing an access bore oriented transversely to the fastener bore in an intersecting relationship with the fastener bore so as to extend inwardly into the beam from an open end of the access bore at an exterior of the beam to a terminal end of the access bore embedded within the beam;

abutting said one of the end faces with the upright supporting surface of the supporting body;

mounting a threaded connector rod in the supporting body to protrude outwardly from an upright supporting surface of the supporting body and into the fastener bore in the beam;

mounting a threaded mating connector within the access bore;

forming a threaded mechanical connection between the threaded mating connector and the threaded connector rod such that tightening the threaded mating connector onto the threaded connector rod clamps the end face of the beam against the upright supporting surface;

plugging the access bore with a plug of heat insulating material; and locating the threaded mating connector and the threaded connector rod within the beam such that a minimum thickness of the wood material of the beam between threaded mating connector and exterior surfaces of the beam on all sides of the threaded mating connector is greater than a char rate of the wood material of the beam multiplied by the prescribed fire resistant duration.

2. The method according to claim 1 wherein the heat insulating material of the plug comprises the same wood material forming the beam.

3. The method according to claim 1 including locating the threaded mating connector and the threaded connector rod within the beam such that the fastener bore is laterally centered between two exterior side surfaces of the beam.

4. The method according to claim 1 including locating the threaded mating connector and the threaded connector rod within the beam such that a vertical space from the fastener bore to each of top and bottom exterior surfaces of the beam are arranged to be greater than a lateral distance of the fastener bore to either of two side exterior surfaces of the beam.

5. The method according to claim 1 including locating the threaded mating connector and the threaded connector rod within the beam such that a length of an end portion of the connector rod that is embedded within the beam is greater than a distance radially of the fastener bore to any exterior surface of the beam.

6. The method according to claim 1 wherein the prescribed fire resistant duration is 60 minutes.

7. The method according to claim 1 further comprising:

providing a second bore extending longitudinally into the beam from an open end of the second bore at one of the end faces of the beam to a terminal end of the second bore embedded within the beam such that the second bore is parallel to and vertically spaced from said fastener bore;

providing a fastener bore extending longitudinally into the beam from an open end of the fastener bore at one of the end faces of the beam to a terminal end of the fastener bore embedded within the beam;

providing a second access bore oriented transversely to the second bore in an intersecting relationship with the second bore so as to extend inwardly into the beam from an open end of the second access bore at the exterior of the beam to a terminal end of the second access bore embedded within the beam;

mounting a second threaded connector rod in the supporting body to protrude outwardly from an upright supporting surface of the supporting body and into the second bore in the beam;

mounting a second threaded mating connector within the second access bore;

forming a second threaded mechanical connection between the second threaded mating connector and the second threaded connector rod so as to fasten the end face of the beam against the upright supporting surface; and plugging the second access bore with a second plug of heat insulating material;

locating the second threaded mating connector and the second threaded connector rod within the beam such that the minimum thickness of the beam between all threaded mating connectors and respective exterior surfaces of the beam on all sides of the threaded mating connectors is greater than the char rate of the wood material of the beam multiplied by the prescribed fire resistant duration.

8. The method according to claim 7 including locating the threaded mating connectors and the threaded connector rods within the beam such that the fastener bore and the second bore are both laterally centered between two exterior side surfaces of the beam.

9. The method according to claim 7 including locating the threaded mating connectors and the threaded connector rods within the beam such that a vertical space from each of the fastener bore and the second bore to each of top and bottom exterior surfaces of the beam are arranged to be greater than a lateral distance of the fastener bore and the second bore to either of two side exterior surfaces of the beam.

10. The method according to claim 7 including locating the threaded mating connectors and the threaded connector rods within the beam such that a length of an end portion of each connector rod that is embedded within the beam is greater than a distance radially of the connector rods to any exterior surface of the beam.

* * * * *